US012188682B2

(12) United States Patent
Wang et al.

(10) Patent No.: US 12,188,682 B2
(45) Date of Patent: Jan. 7, 2025

(54) EVAPORATIVE-COOLING WINDOW FAN

(71) Applicants: Chi Hsiang Wang, Burnaby (CA); Hao Han Wang, Burnaby (CA)

(72) Inventors: Chi Hsiang Wang, Burnaby (CA); Hao Han Wang, Burnaby (CA)

( * ) Notice: Subject to any disclaimer, the term of this patent is extended or adjusted under 35 U.S.C. 154(b) by 173 days.

(21) Appl. No.: 18/101,239

(22) Filed: Jan. 25, 2023

(65) Prior Publication Data

US 2024/0247820 A1 Jul. 25, 2024

(51) Int. Cl.

| | |
|---|---|
| ***F24F 6/04*** | (2006.01) |
| ***F24F 7/013*** | (2006.01) |
| ***F24F 13/10*** | (2006.01) |

(52) U.S. Cl.

CPC ..... *F24F 6/043* (2013.01); *F24F 7/013* (2013.01); *F24F 13/10* (2013.01)

(58) Field of Classification Search

CPC ..... F24F 6/043; F24F 6/02; F24F 6/04; F24F 7/013; F24F 7/007; F24F 2007/005; F24F 13/10; F24F 13/18; F24F 1/039; F24F 1/027; F24F 1/031; F24F 2006/006; F24F 2006/008; F24F 2221/20

See application file for complete search history.

(56) References Cited

U.S. PATENT DOCUMENTS

2012/0267804 A1* 10/2012 Rodrigs ..... F24F 6/04 261/107
2019/0193526 A1* 6/2019 Stark ..... F24F 13/15

FOREIGN PATENT DOCUMENTS

CN 221483719 U * 8/2024

OTHER PUBLICATIONS

English translation of Xu (CN 221483719 U) (Year: 2024).*

* cited by examiner

*Primary Examiner* — Miguel A Diaz
(74) *Attorney, Agent, or Firm* — Frank Marino

(57) ABSTRACT

An evaporative-cooling window fan is configured to draw air from outdoors to indoors such that it is cooled and filtered as it passes there-through.

14 Claims, 15 Drawing Sheets

Fig 12
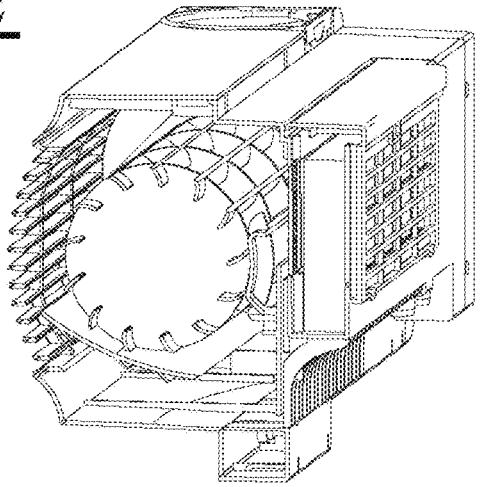
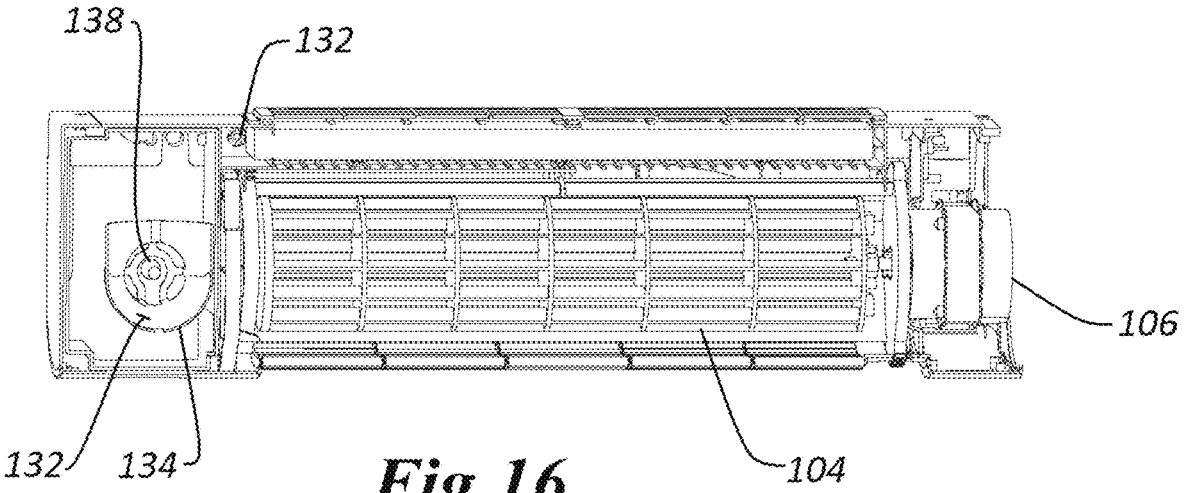
Fig 16

EVAPORATIVE-COOLING WINDOW FAN

FIELD OF THE INVENTION

This invention relates to window fans and evaporative air coolers, and to improvements thereto.

BACKGROUND OF THE INVENTION

Window fans and evaporative air coolers have both existed for many decades. Window fans are generally intended to push air through an open widow, either from the outdoors to the indoors or vice-versa. Numerous studies have shown that even in the most polluted cities, outdoor air is cleaner than indoor air, so exchanging outside air with indoor air freshens and cleans the air in the room.

Evaporative air coolers reduce the temperature of air by Evaporative air coolers, sometimes referred to as swamp coolers, typically pass dry air over a water-saturated porous pad, the water in the pad evaporates. Water has a heat of vaporization value of 40.65 KJ/mol. 586 calories per mole of beat energy is required to accomplish the evaporation and that energy is reflected in a drop in the temperature of the now moistened air. This energy and is absorbed by the process as removed heat. This reduces the air temperature by 15 F to 40 F as it is sent into the home.

But the temperature reduction is proportional to the relative humidity level of the incoming air, so a drawback of evaporative cooling is that when used within a closed environment, evaporative air coolers become less effective during operation. For example, in a room starting off at a low RH, the temperature reduction may initially be significant. But as a result of the evaporation the room's RH will increase during operation. As the RH approaches 100, the temperature drop would become negligible.

Regardless of temperature effects, the porosity and moistness of evaporative cooling pad also filters air passing there through.

Purified drinking water is often sold inexpensively in disposable plastic bottles. Such bottles generally include and are adapted to receive the same standardized female-threaded cap, meaning that almost all of such bottles include the same male-threaded neck. Such bottles are typified by that shown at www.berlinpackaging.com/pet-plastic-water bottles, the disclosure thereof being incorporated herein by reference in its entirety. Such bottles typically include a PCO1881 thread. The thread spec is available at www.imajeenyus.com/mechanical/20120508_bottle_top-_threads/28mm-ISBT-PCO-1881-Finish-3784253-17.pdf, the disclosure thereof being incorporated herein by reference in its entirety. Note that the outside diameter of the nominal 28 mm thread is actually 27.4 mm and the pitch is 2.7 mm. While some of the other common threads vary slightly, the tolerances and flexibility of the bottles and caps enable effective compatibility.

There exists the need and it is an object of the invention to provide a method and apparatus to simultaneously and effectively clean, freshen, and cool room air that solves the drawbacks of prior art, and such is an object and accomplishment of the invention disclosed herein.

There also exists the need and it is an object of the invention to provide such a method and apparatus which additionally selectively enables the exhaust of stale indoor, and such is an object and accomplishment of the invention disclosed herein.

There also exists the need and it is an object of the invention to provide such a method and apparatus which enables the exhaust of stale indoor without passing it through its evaporative-cooling system, and such is an object and accomplishment of the invention disclosed herein.

There also exists the need and it is an object of the invention to provide such a method and apparatus which additionally selectively enables control of the direction of cooling airflow, and such is an object and accomplishment of the invention disclosed herein.

There also exists the need and it is an object of the invention to provide such a method and apparatus which is adapted to employ water from inexpensive standard plastic purified drinking water bottles.

Additional needs and objects will become apparent from a reading of the following information.

SUMMARY OF THE INVENTION

The present invention may be embodied in or practiced using a window fan including an evaporative air cooling system that simultaneously and effectively cleans, freshens, and cools room air.

The evaporative-cooling window fan may have a housing with a first intake opening, a first exhaust opening, a blower, an evaporative pad, and a reservoir there-within. The housing may be adapted to engage an open window such that the first intake opening is outdoors and the first exhaust opening is indoors. The blower may be configured to rotate and draw air through the housing into the first intake opening and out of the first exhaust opening creating an airflow. The reservoir may be adapted to receive and contain water. A lower portion of the pad may be water-absorbent and disposed in the water. An upper portion of the pad may adapted and disposed to allow the airflow therethrough. The upper portion may be adapted by wicking to draw water from the lower portion to become moistened, such that the airflow is cooled by evaporation as it passes from outdoors, through the first intake opening, through the moistened upper portion, through the first exhaust opening, and to indoors. A manually-rotatable director may surround the blower and be adapted to direct the airflow therefrom according to a plurality of user-selectable rotational positions.

The housing may further have a second exhaust opening, disposed outdoors, and wherein one of the user-selectable positions may cause an indoor-to-outdoor airflow direction wherein air is drawn through the housing into the first exhaust opening and out of the second exhaust opening such that the first intake opening is a second intake opening. The indoor-to-outdoor airflow might not pass though the upper portion of the pad. One of the user-selectable positions may cause an upwardly-directed outdoor-to-indoor airflow direction and another of the user-selectable positions may cause a downwardly-directed outdoor-to-indoor airflow. The director may enable the outdoor-to-indoor and indoor-to-outdoor airflows while the blower rotates in the same direction.

The housing may further include a bottle receiver adapted to receive and support a removable and replaceable water supply for filling the reservoir to a desired water level such that the water is retained thereat. The reservoir may have a valve actuator and the water supply may be a bottle and cap assembly. The cap assembly may include a valve actuated by the valve actuator when the water supply is received and supported in the bottle receiver. The cap may have a nominal 28 mm thread. The bottle may be a disposable plastic purified drinking water bottle.

Many aspects of the invention can be better understood with reference to the following detailed description of an exemplary evaporative-cooling window fan along with the accompanying drawings. The components in the drawings are not necessarily to scale, emphasis instead being placed upon clearly illustrating the principles of the invention.

BRIEF DESCRIPTION OF THE DRAWINGS

FIG. 12 is a cross-sectional view of the evaporative-cooling window fan of FIG. 1 in its exhaust configuration taken at line 9-9 of FIG. 2;

FIG. 16 is a top view showing the water reservoir system of the evaporative-cooling window fan of FIG. 1;

DETAILED DESCRIPTION OF THE INVENTION

Figure 1:
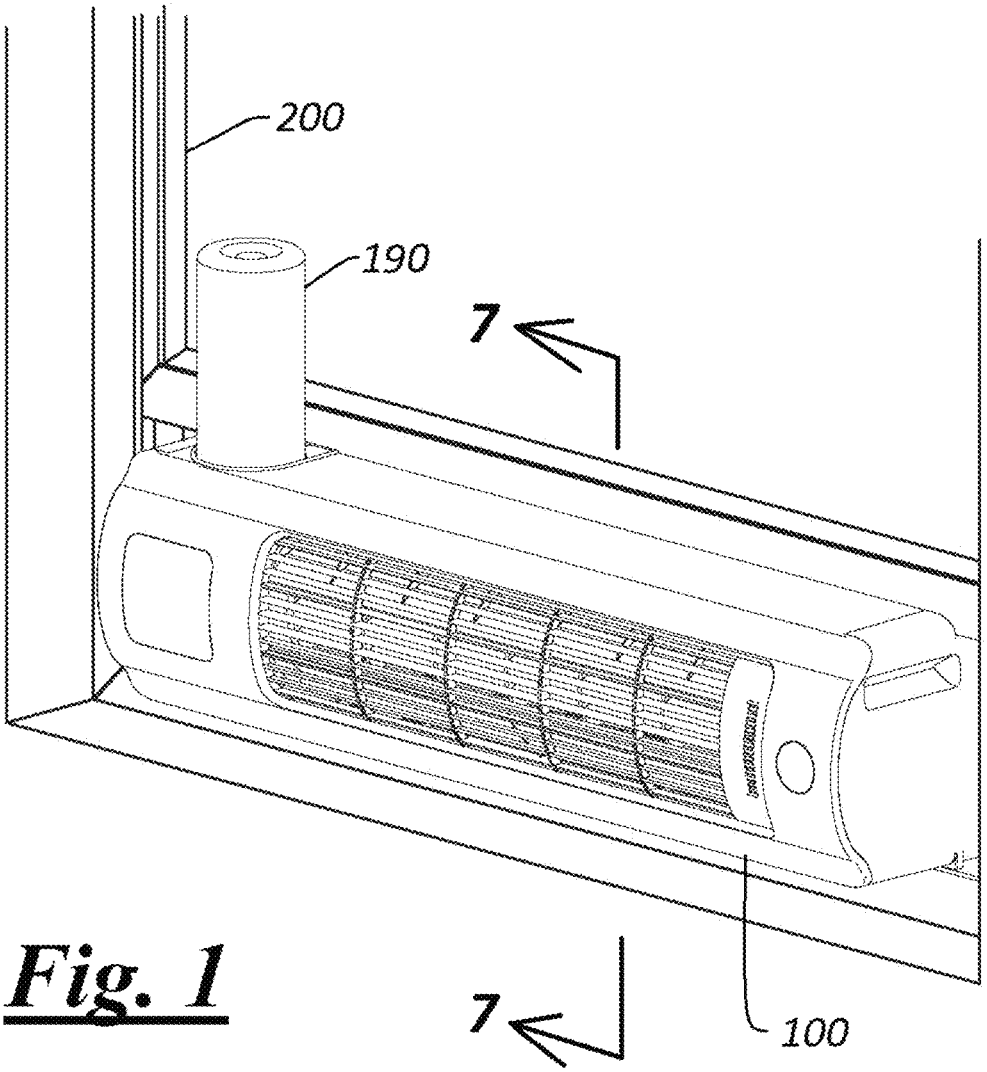
FIG. 1 is a perspective view of an exemplary evaporative-cooling window fan according to or useful in practicing the invention mounted in a typical double-hung window.
Figure 2:
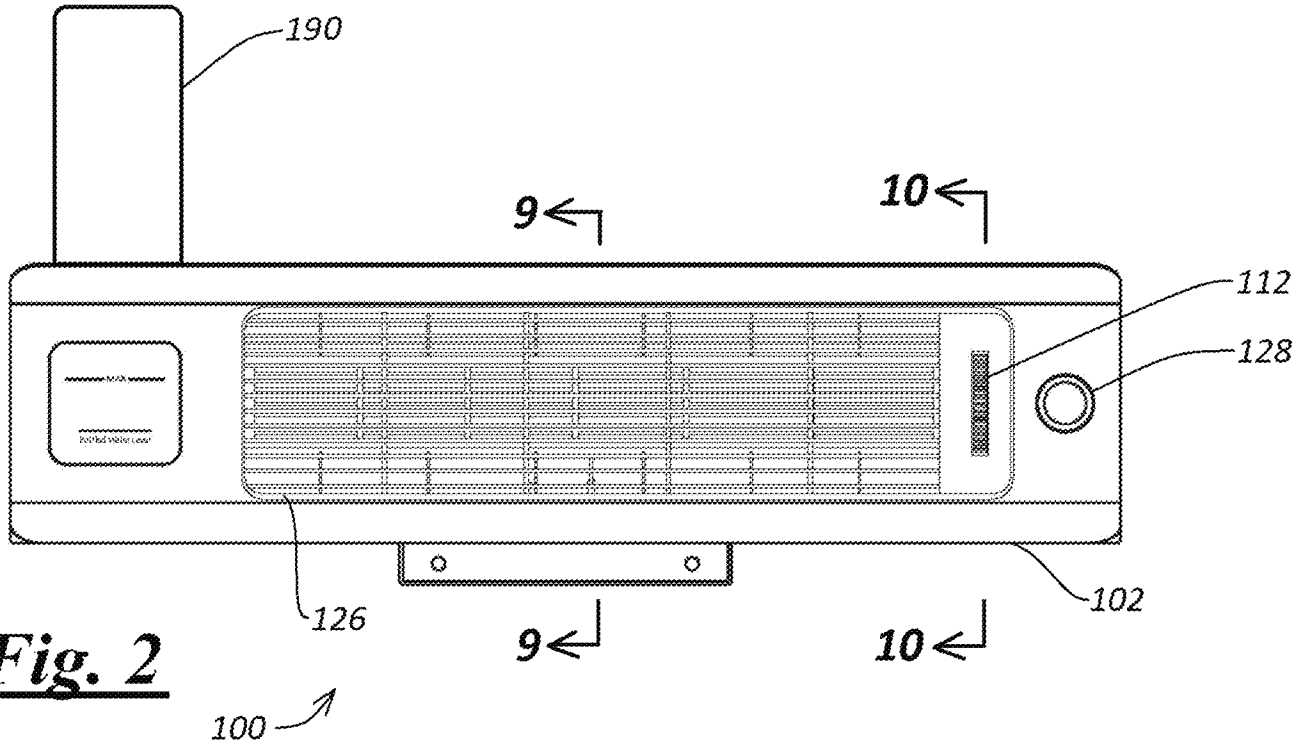
FIG. 2 is a front view of the evaporative-cooling window fan of FIG. 1.
Figure 3:
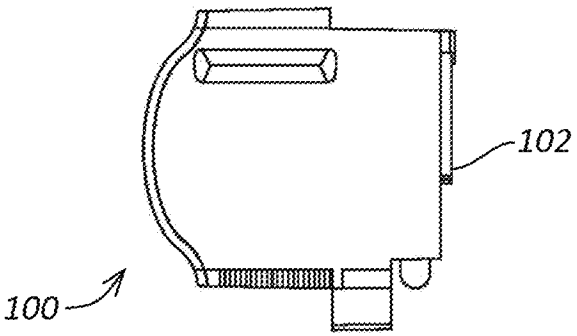
FIG. 3 is a side view of the evaporative-cooling window fan of FIG. 1.
Figure 4:
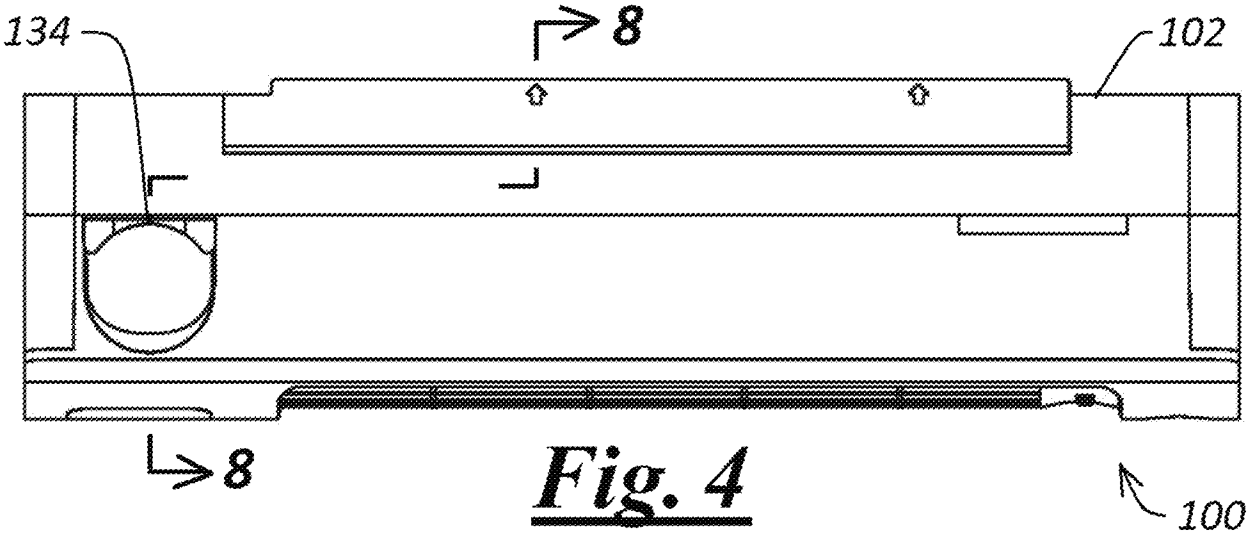
FIG. 4 is a top view of the evaporative-cooling window fan of FIG. 1.
Figure 5:
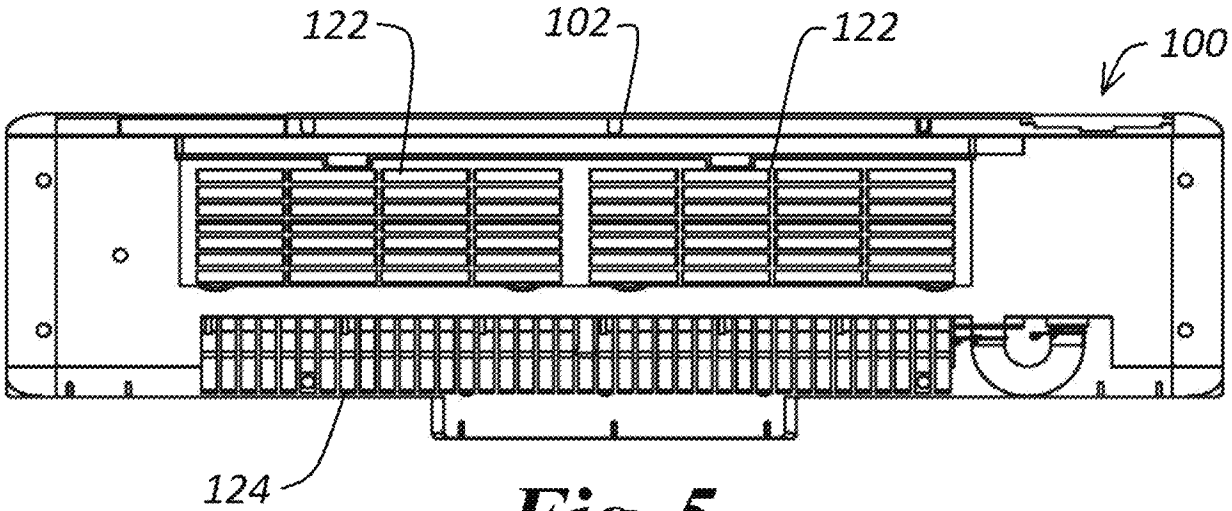
FIG. 5 is a rear view of the evaporative-cooling window fan of FIG. 1.
Figure 6:
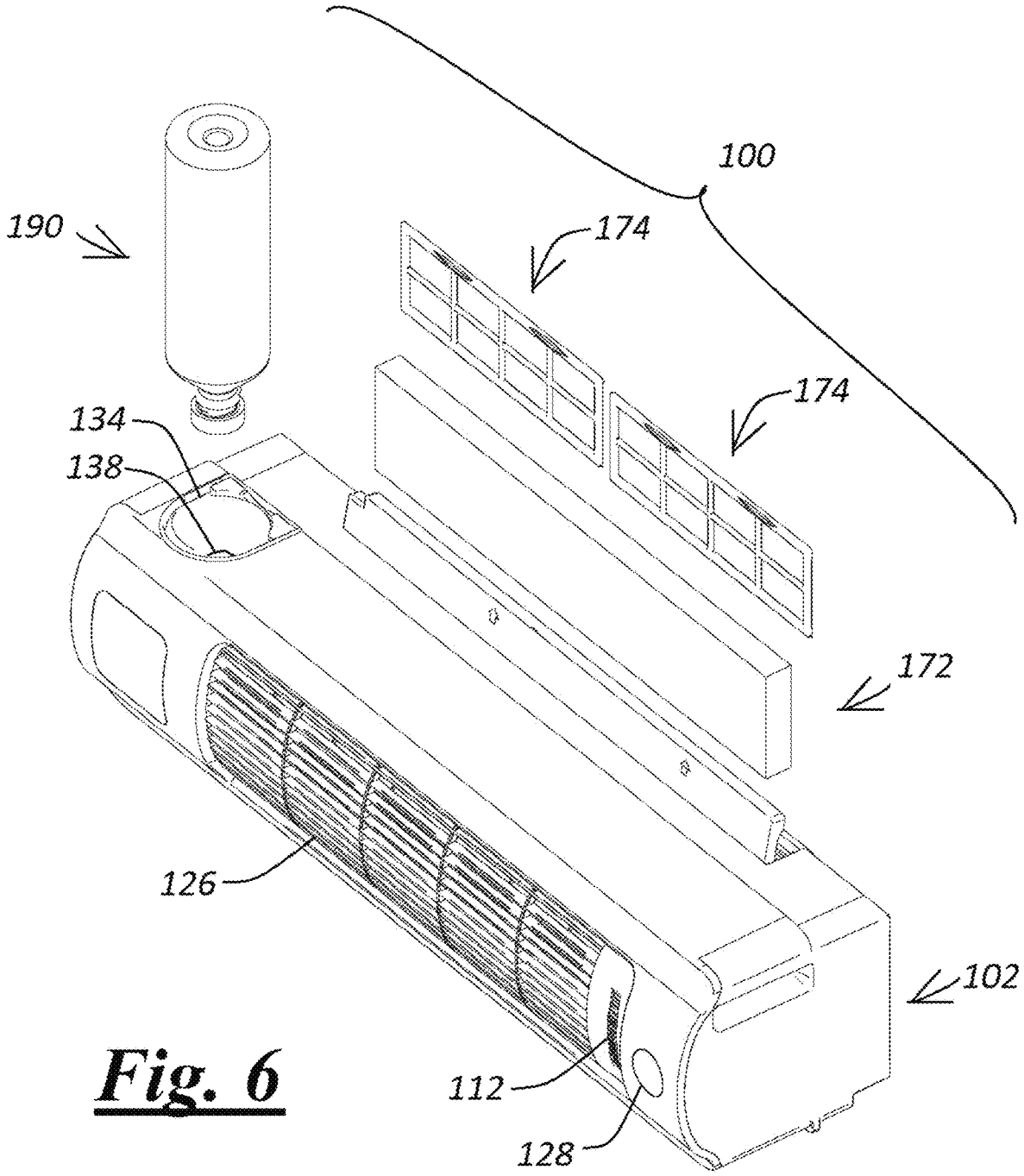
FIG. 6 is an exploded view of the evaporative-cooling window fan of FIG. 1.
Figure 7:
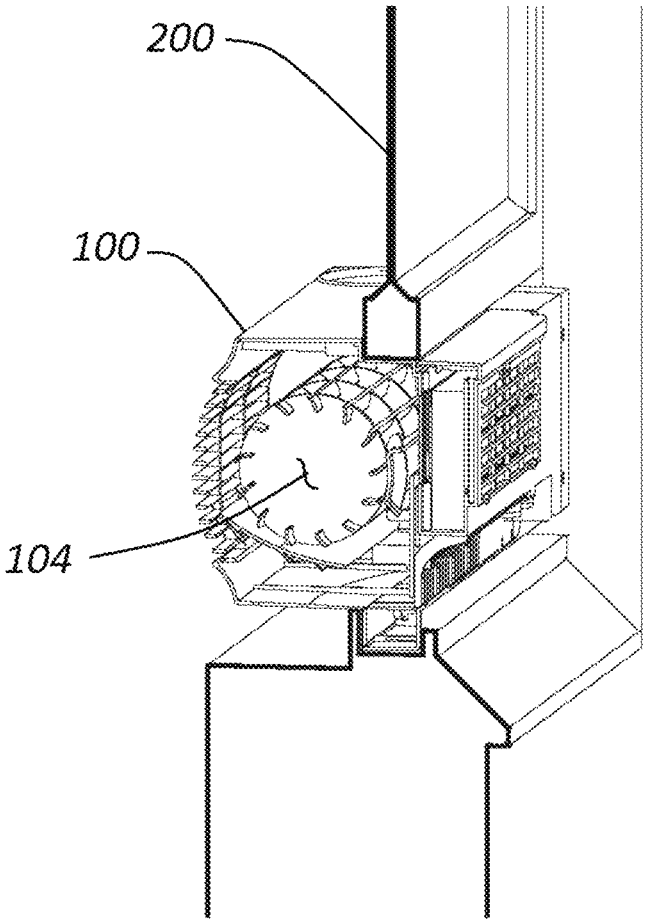
FIG. 7 is a cross-sectional view of the evaporative-cooling window fan of FIG. 1 in the window of FIG. 1 taken at line 7-7 of FIG. 1.
Figure 8:
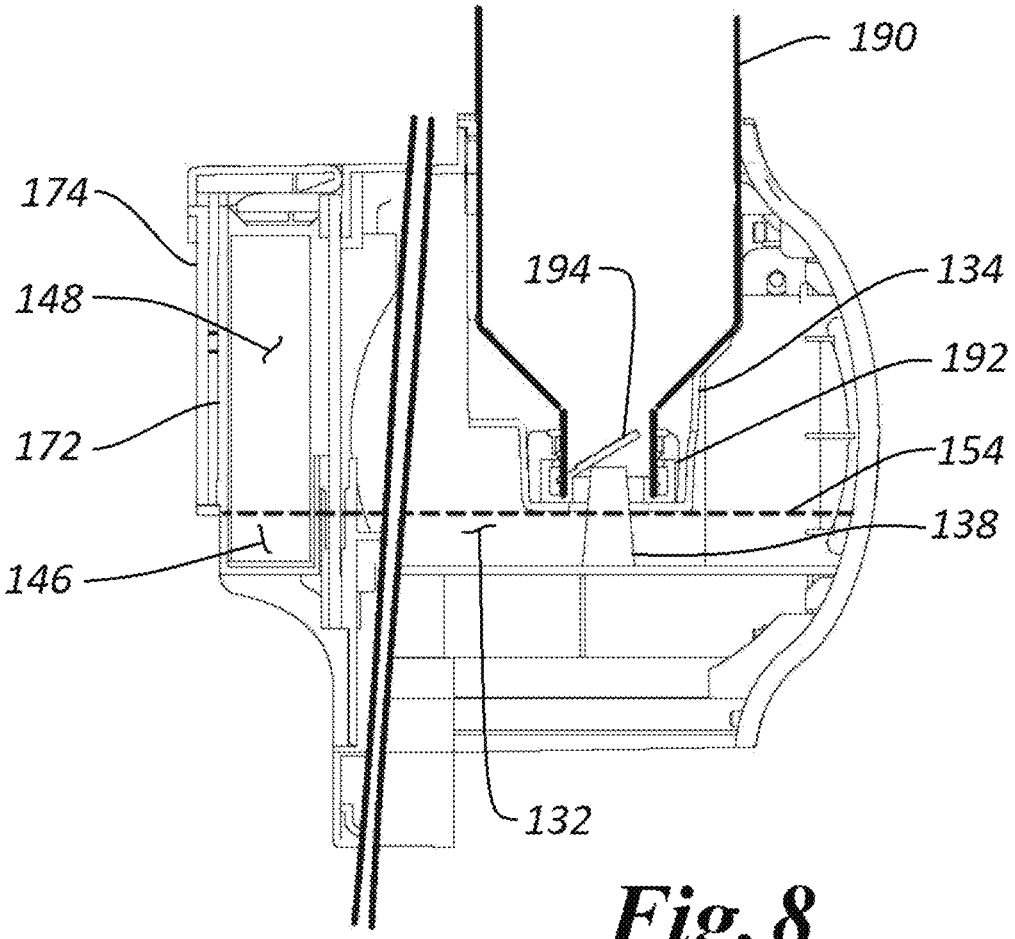
FIG. 8 is a cross-section view of the water supply of the evaporative-cooling window fan of FIG. 1 taken at line 8-8 of FIG. 4.
Figures 9A, 9B, 9C:
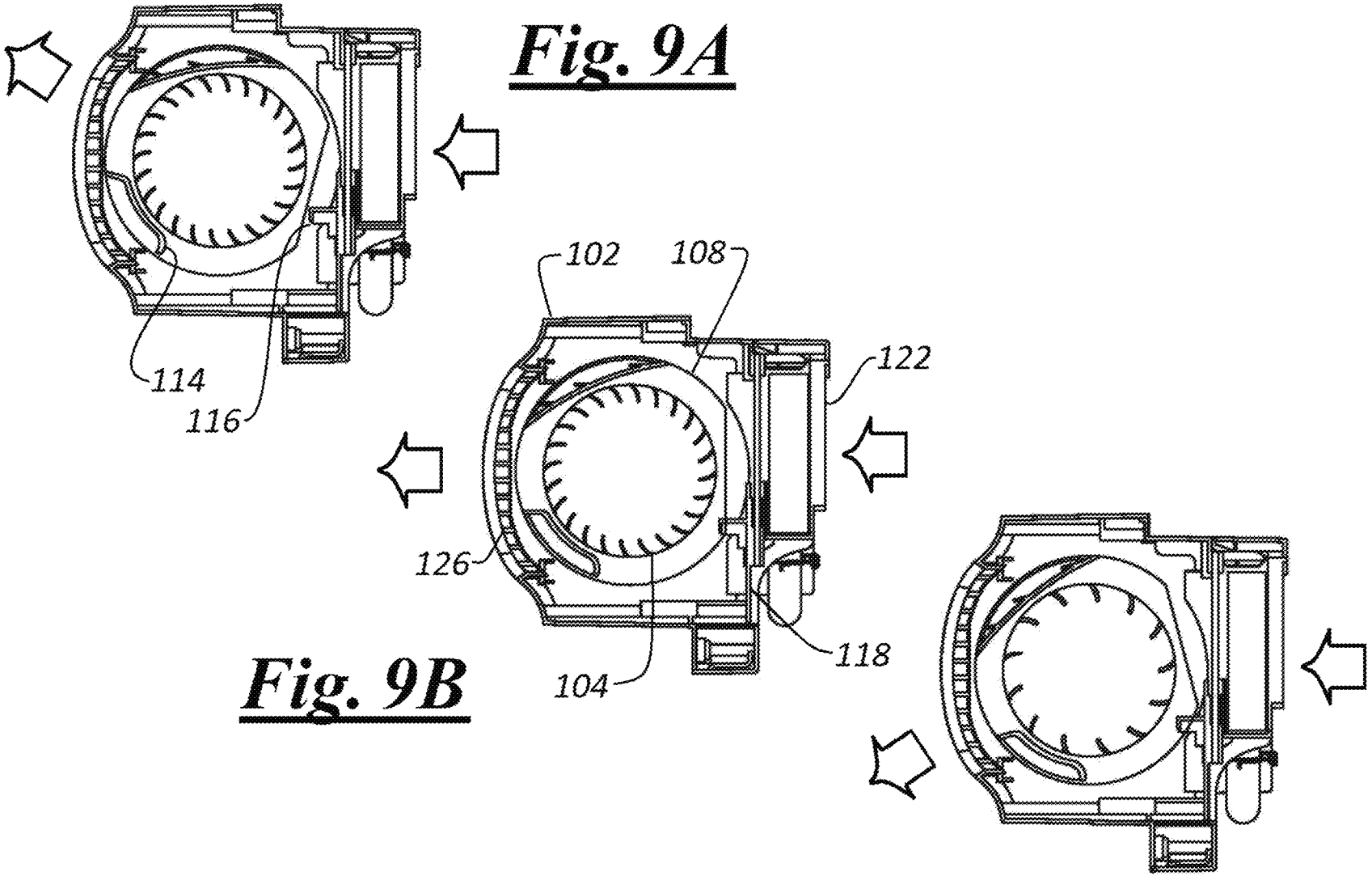
FIG. 9A is a cross-sectional view of the evaporative-cooling window fan of FIG. 1 in its upward-flowing configuration taken at line 9-9 of FIG. 2.
FIG. 9B is a cross-sectional view of the evaporative-cooling window fan of FIG. 1 in its horizontal-flowing configuration taken at line 9-9 of FIG. 2.
FIG. 9C is a cross-sectional view of the evaporative-cooling window fan of FIG. 1 in its downward-flowing configuration taken at line 9-9 of 9-9 of FIG. 2.
Figure 9D:
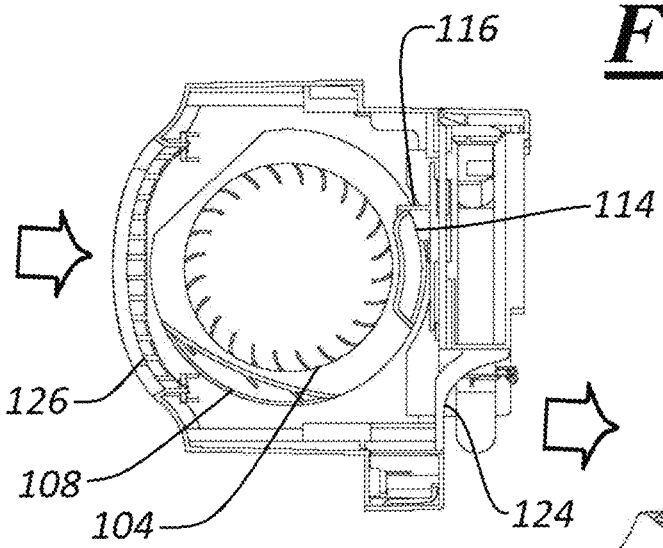
FIG. 9D is a cross-sectional view of the evaporative-cooling window fan of FIG. 1 in its exhaust configuration taken at line 9-9 of 9-9 of FIG. 2.
Figure 10D:
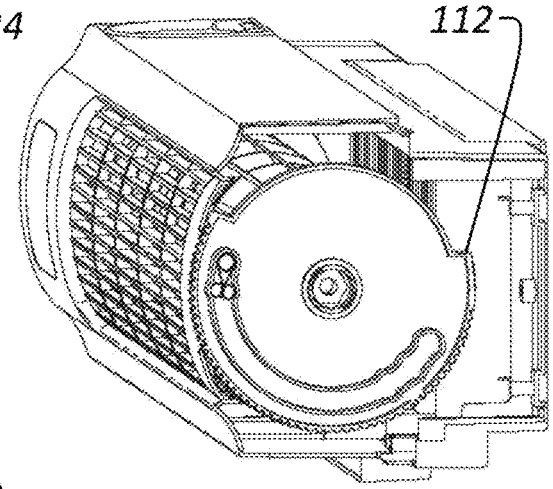
FIG. 10D is a cross-sectional view of the evaporative-cooling window fan of FIG. 1 in its exhaust configuration taken at line 10-10 of FIG. 2.
Figure 10A:
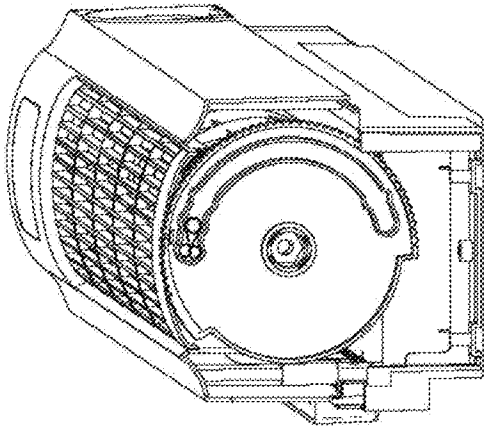
FIG. 10A is a cross-sectional view of the evaporative-cooling window fan of FIG. 1 in its upward-flowing configuration taken at line 10-10 of FIG. 2.
Figure 10B:
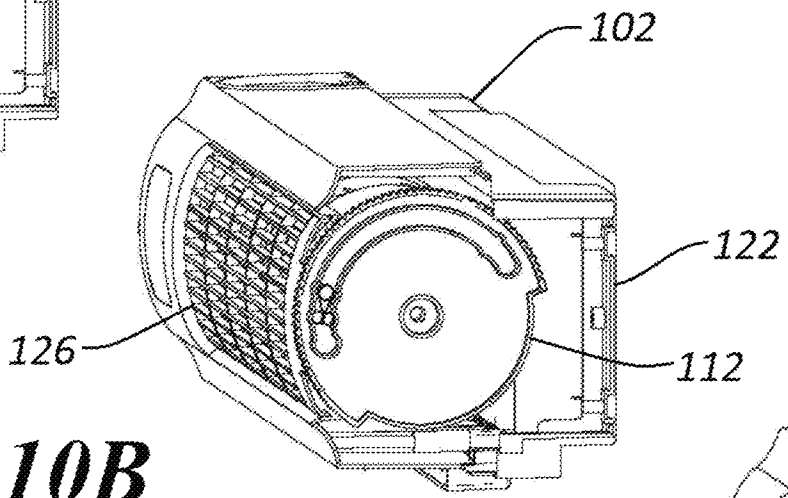
FIG. 10B is a cross-sectional view of the evaporative-cooling window fan of FIG. 1 in its horizontal-flowing configuration taken at line 10-10 of FIG. 2.
Figure 10C:
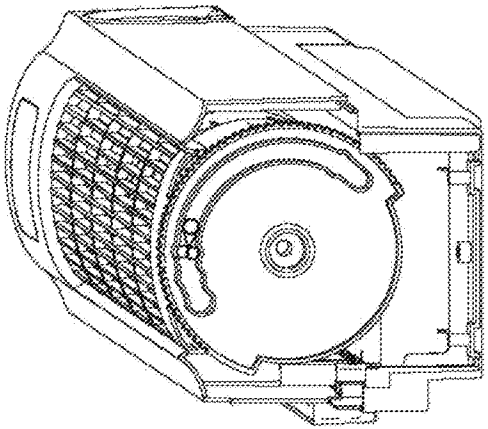
FIG. 10C is a cross-sectional view of the evaporative-cooling window fan of FIG. 1 in its downward-flowing configuration taken at line 10-10 of FIG. 2.

Referring first to FIGS. 1 through 16, there is shown an evaporative-cooling window fan 100. The fan has a housing 102 adapted to engage a partially-open double-hung window 200. The housing includes a rear intake grill 122 and a front grill 126 and is adapted such that the rear intake grill is outdoors and the front grill is indoors when the housing engages the window as shown in FIGS. 1 and 7.

Figure 17:
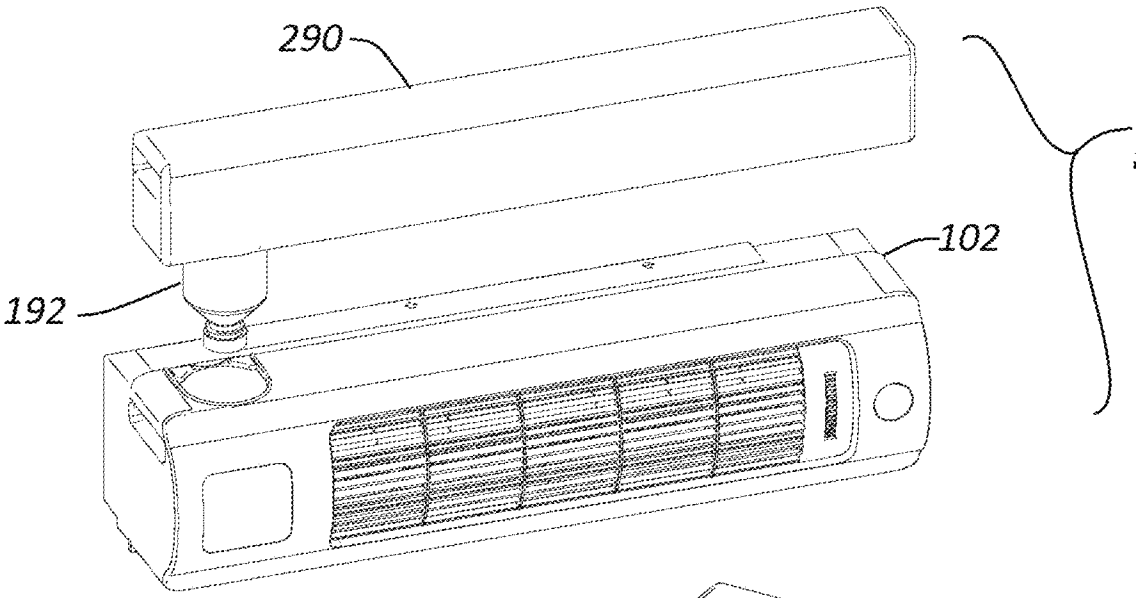
FIG. 17 is an exploded view of the evaporative-cooling window fan of FIG. 1 except having a high-volume reservoir rather than the water filling bottle of FIG. 1.
Figure 18:
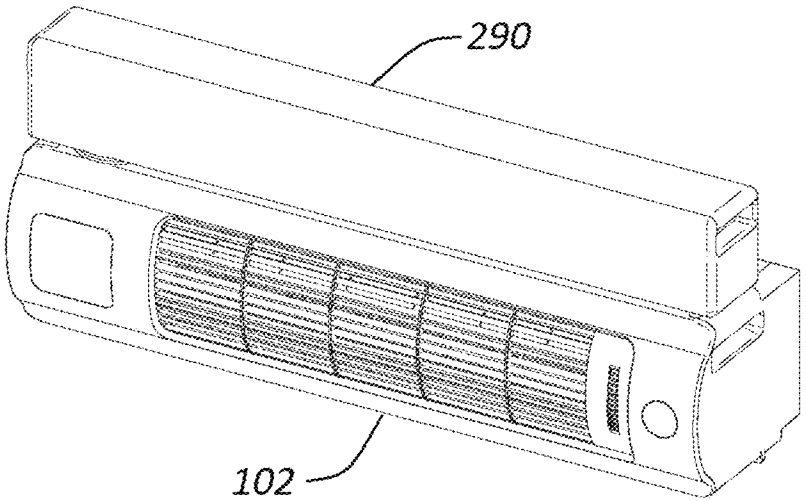
FIG. 18 is a perspective view of the evaporative-cooling window fan of FIG. 17.

The housing is adapted to receive a water bottle 190, an evaporative-cooling pad 172, and air filters 174. The housing is also adapted to receive the alternative high-volume tank 290 of FIGS. 17 and 18 instead of the water bottle, when desired.

The housing contains a horizontally-rotating cylindrical blower wheel 104 driven by a variable-speed electric motor 106. The blower wheel is surrounded by an airflow director 108 coupled to a director-actuating wheel 112 that allows the user to vary the direction of the blower wheel's airflow, while the blower wheel maintains the same rotational direction, including an inward/upward direction, an inward/horizontal direction, an inward/downward direction, and an exhaust direction. The director has a cog 114 that engages a receiver 116 on damper plate 118 as the wheel rotates the director from an inward airflow position to the exhaust position. The damper plate is allowed to drop when the wheel rotates the director from the exhaust position to an inward airflow position. The damper plate blocks airflow through rear intake grill 122 and enables airflow through the rear exhaust grill 124 when in its upward position and enables airflow through the rear intake grill and blocks airflow through the rear exhaust grill when in its downward position. By blocking the rear exhaust grill when in its downward position, the damper plate also blocks the ability for debris and insects to enter the rear exhaust grill.

The deflector is adapted to allow air 206 to be pulled by the blower wheel from the outdoors through the rear intake grill and exhaust it through the front grill and into the indoors when in any of its inward positions and to allow air 208 to be pulled by the blower wheel from the indoors through the front grill and exhaust it through the rear exhaust grill to the outdoors when in its exhaust position, as demonstrated in FIGS. 9A through 11D, without the need to reverse the blower wheel's rotational direction.

The front grill thereby serves as a first exhaust opening, the rear intake grill serves as a first intake opening, and the rear exhaust grill is closed during inward airflow operation and the front grill serves as a second intake opening, the rear exhaust opening serves as a second exhaust opening, and the rear intake grill is closed during outward airflow operation.

Control button 128 enables switch of the blower between Off, and High, Medium, and Low rotational speeds . . . all with the same rotational direction.

The housing also includes water reservoir 132, bottle receiver 134, evaporative pad receiver 136, and air filter receivers.

The bottle receiver is adapted to receive and support bottle 190 or high-volume tank 290. The bottle and tank include the same cap assembly 192 seen in FIGS. 15A-15C, which is disposed at the same vertical level relative to the reservoir for both the bottle and tank. The cap assembly includes normally-closed flapper valve 194 to normally seal water within the bottle or tank.

The cap assembly is adapted to mate with a male thread having an outside diameter of 27.4 mm and a pitch of 2.7 mm so that it may be used together with ubiquitous and inexpensive disposable drinking water bottles. This allows the user to purchase purified water in such bottles, likely inexpensively in bulk, and simply replace the caps with cap assembly 192. Since purified water is less likely to have the impurities and minerals that would shorten the lifetime of the evaporative pad, the ability to use purified water in such an inexpensive form is a key aspect of the invention.

Valve actuator 138 of the reservoir opens the flapper valve as the bottle or tank is inserted to allow water to escape into the reservoir. As the water rises and reaches a desired operational water level 154, it seals the open cap to create a vacuum with the bottle/tank and prevent further escape until the water level lowers to expose the valve and allow air to enter the bottle/tank to simultaneously allow water to escape again. This cycle continues to maintain the water at approximately the desired water level until the bottle or tank becomes empty.

The alternative high-volume tank includes the same cap assembly as does the water bottle and is disposed and adapted to engage the valve actuator in the same way while the tank rests atop the housing, to cause the same desired water level. The larger volume of water in the tanks merely enables less frequent re-fillings.

The evaporative-cooling pad and air filters are inserted into the housing through the evaporative pad and air filter receivers. The air filters are positioned upstream in the inward airflow from the evaporative pad to remove bugs and particles that might otherwise clog the pad before they reach the pad. The pad is disposed such that a lower portion 146 rests in the reservoir and is submerged in and soaked by the reservoir's water. The pad's upper portion 148 is disposed in the inward airflow.

The pad is constructed of an absorbent and porous material so that the water in which the lower portion resides is wicked upward into the upper portion to moisten the upper portion while the inward airflow is allowed through the upper portion. A typical prior art pad is disclosed in U.S. Pat. No. 8,038,128, the entirety of which is incorporated herein by reference. Many other prior art evaporative humidifier and air cooler pads may be substituted therefore without straying from the present invention.

As seen in FIGS. 1, 2, 6, 17, and 18, either the water-filled bottle or tank is inserted into the bottle receiver such that the cap's flapper valve is opened by the valve actuator and its water is allowed to fill the reservoir to the desired water level. The upper portion of the pad then becomes moistened by wicking the water from the submerged lower portion.

Referring to FIGS. 9A-10D, the director-actuating wheel is set to cause the director and damper plate into one of the inward airflow positions. The motorized blower is energized to cause an airflow from outdoors, through the air filter where it is cleaned of insects and particles, through the moistened upper portion of the pad where the airflow becomes moistened and drops in temperature, through the front grill, and into the indoors.

Figure 11D:
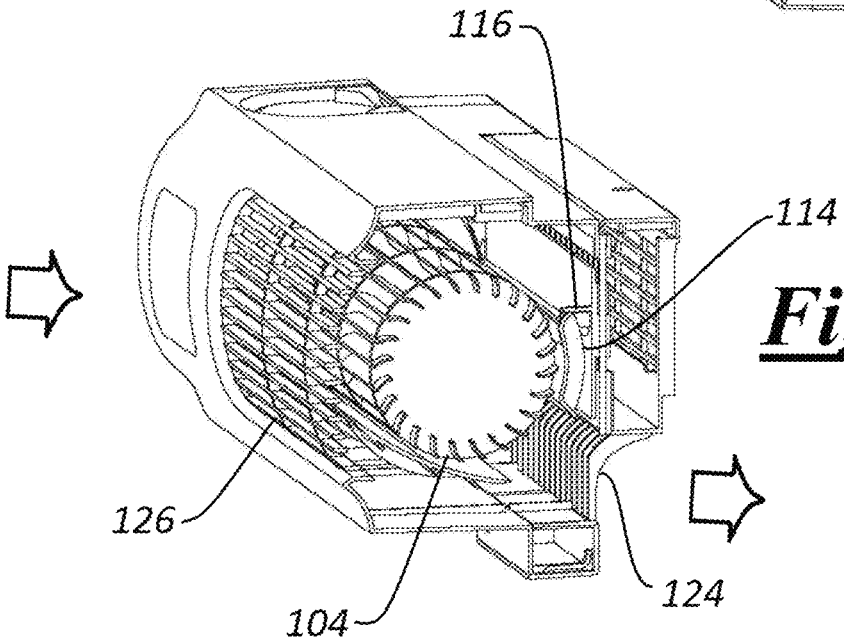
FIG. 11D is a cross-sectional view of the evaporative-cooling window fan of FIG. 1 in its exhaust configuration taken at line of 9-9 of FIG. 2.
Figures 11A, 11B, 11C:
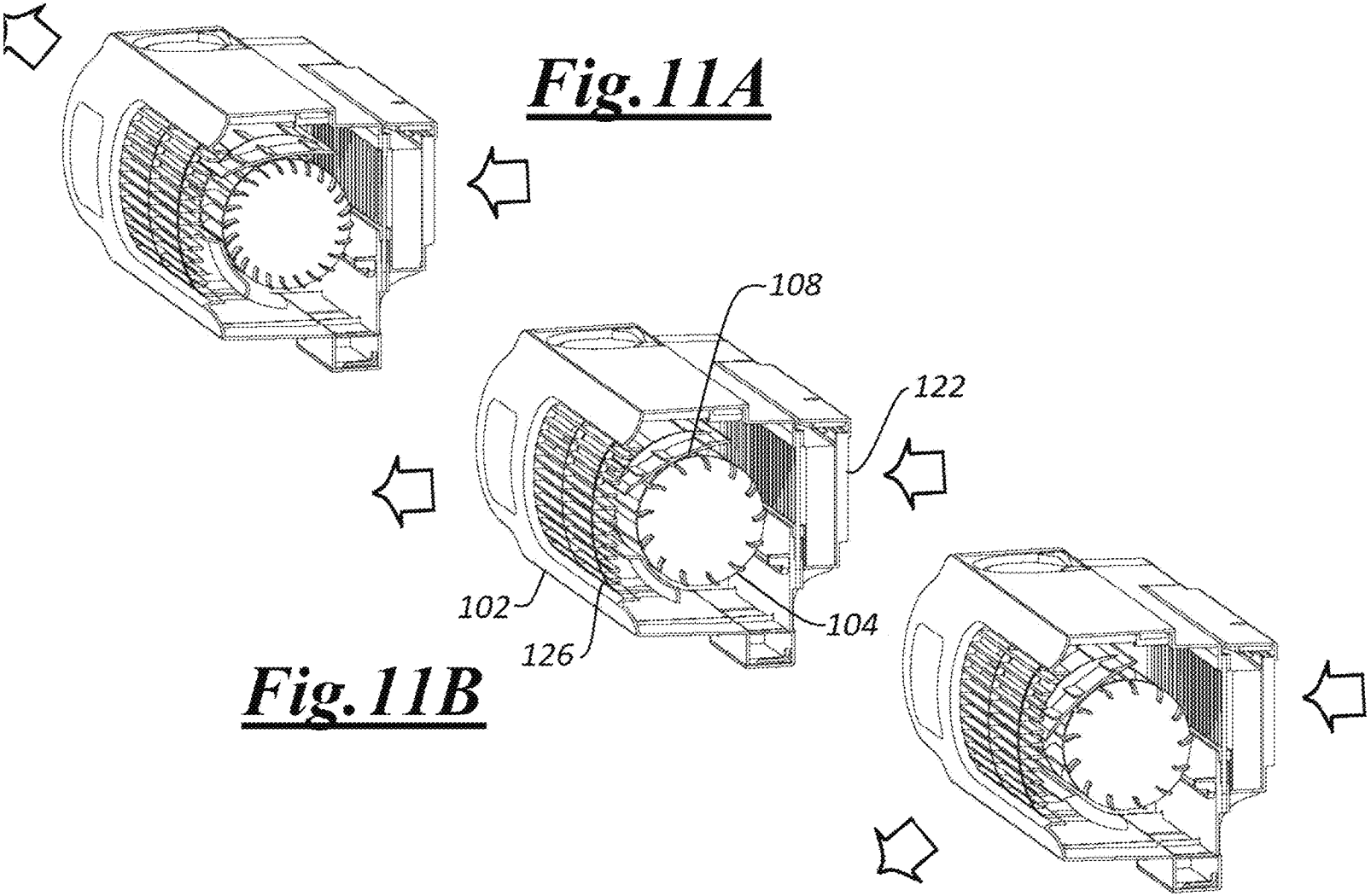
FIG. 11A is a cross-sectional view of the evaporative-cooling window fan of FIG. 1 in its upward-flowing configuration taken at line 9-9 of FIG. 2.
FIG. 11B is a cross-sectional view of the evaporative-cooling window fan of FIG. 1 in its horizontal-flowing configuration taken at line 9-9 of FIG. 2.
FIG. 11C is a cross-sectional view of the evaporative-cooling window fan of FIG. 1 in its downward-flowing configuration taken at line 9-9 of FIG. 2.
Figure 13:
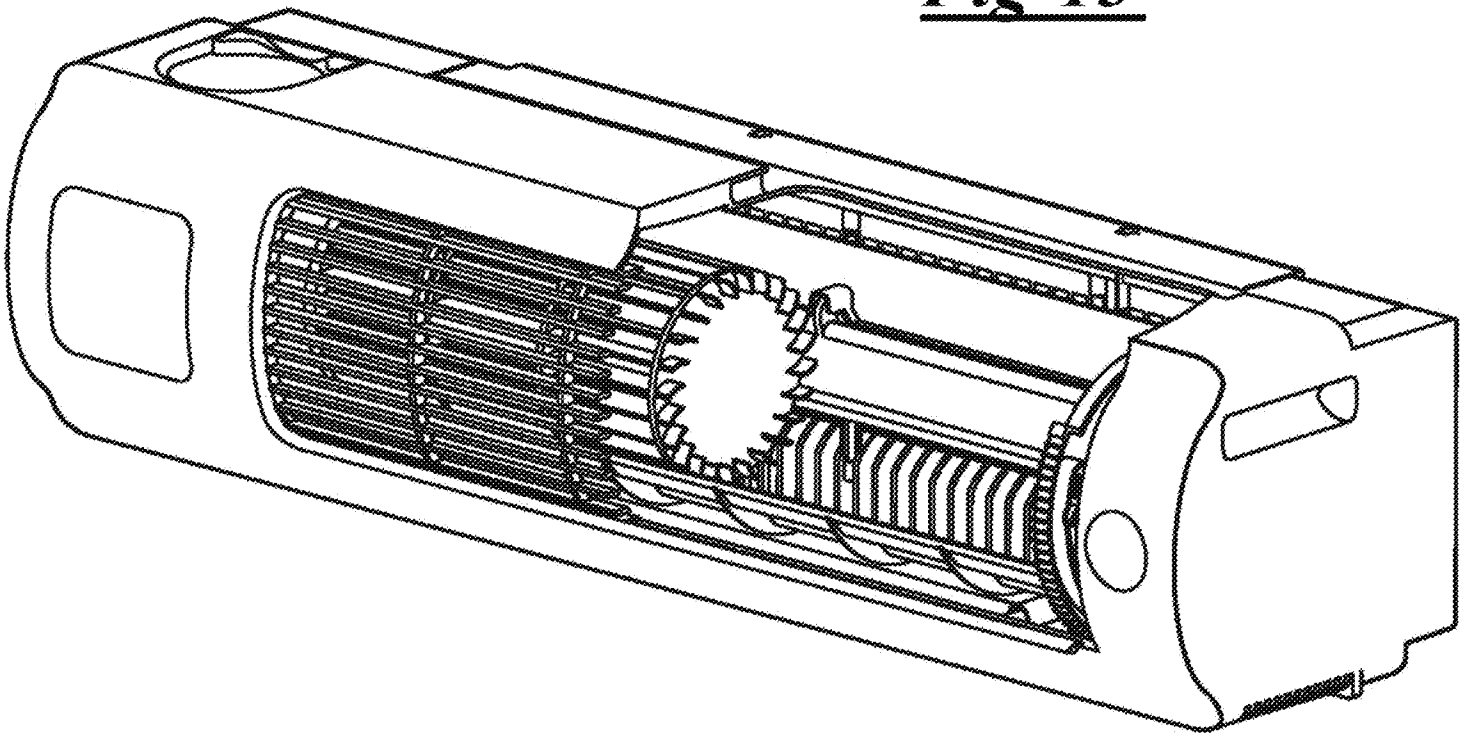
FIG. 13 is a broken-away perspective view of the evaporative-cooling window fan of FIG. 1.
Figure 14:
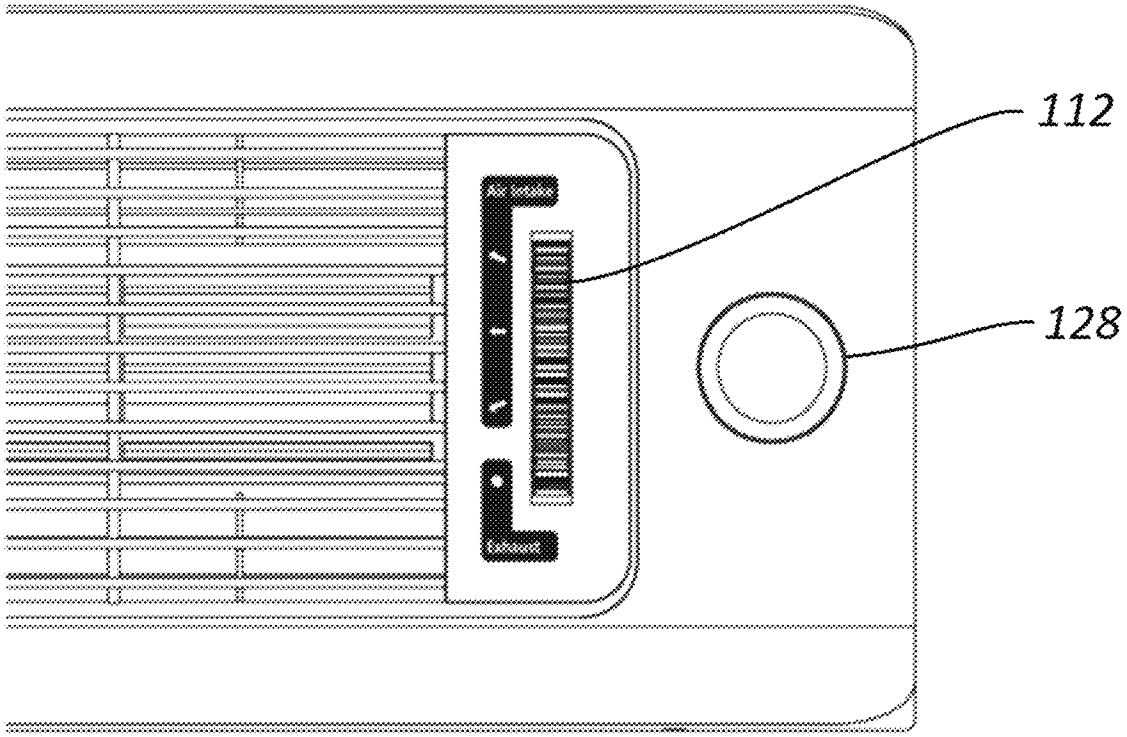
FIG. 14 is a partial front view of the control panel of the evaporative-cooling window fan of FIG. 1.
Figure 15A:
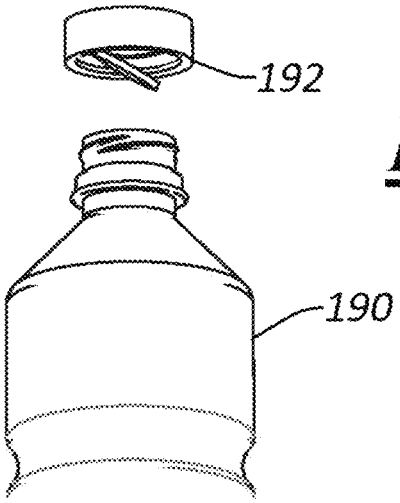
FIG. 15A is a partial exploded view of the water-filling bottle of the evaporative-cooling window fan of FIG. 1.
Figure 15B:
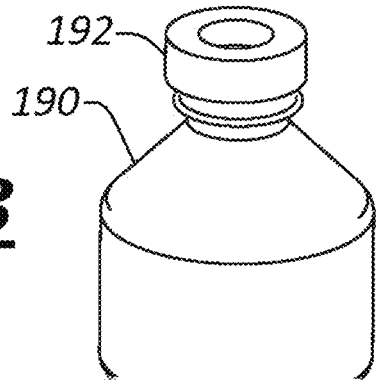
FIG. 15B is a partial assembled view of the water-filling bottle of the evaporative-cooling window fan of FIG. 1.
Figure 15C:
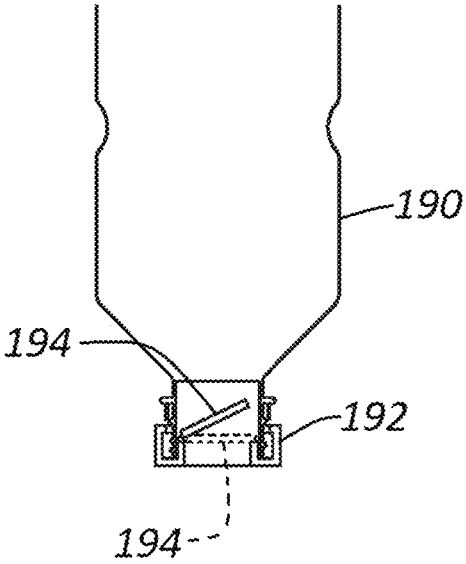
FIG. 15C is a partial full cross-sectional view of the water-filling bottle of the evaporative-cooling window fan of FIG. 1.

Alternatively, referring to FIGS. 11A-12, the director-actuating wheel is set to cause the director and damper plate into the outward airflow position and the motorized blower is energized to cause an airflow from indoors, through the front grill, through the rear exhaust opening, and into the outdoors without passing through the pad's upper portion.

A key aspect of this configuration is that air is not passed though the evaporative pad during outward airflow operation. It is established that in addition to the wicking of water from the reservoir, the upper portion also unintentionally wicks any minerals or impurities contained in the water. As these things do not evaporate, they collect in the upper portion and reduce its absorbency and porosity over time. These are the very things that limit the effective lifetime of the evaporative pad. If the outward airflow was to otherwise be passed through the upper portion, not only would reserved water be wasted to cool the outdoors, but the lifetime of the pad would also be unnecessarily shortened. The outward exhaustion of the air flow without passing through the pad extends the life of the pad and saves water and is no trivial or obvious aspect of the device.

Another key aspect is that the inward airflows and outward airflow are accomplished without reversal of the blower wheel's rotation. Not only are reversible motors far more expensive than single-directional motors, but blower wheels that are configured for one direction operation are far more efficient and effective than those that are designed for have blades shaped for two direction operation, so a less expensive motor may be used to create the same amount of airflow, with quieter and more economic operation.

While the invention has been by the above specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

We claim:

1. An evaporative-cooling window fan comprising:

a housing having a first intake opening, a first exhaust opening, a blower, an evaporative pad, and a reservoir there-within, wherein;

the housing is adapted to engage an open window such that the first intake opening is outdoors and the first exhaust opening is indoors;

the blower is configured to rotate and draw air through the housing into the first intake opening and out of the first exhaust opening creating an airflow;

the reservoir is adapted to receive and contain water;

a lower portion of the pad is water-absorbent and is disposed in the water;

an upper portion of the pad is adapted and disposed to allow the airflow therethrough;

the upper portion is adapted by wicking to draw water from the lower portion to become moistened; such that the airflow is cooled by evaporation as it passes from outdoors, through the first intake opening, through the moistened upper portion, through the first exhaust opening, and to indoors;

further comprising a manually-rotatable director surrounding the blower and adapted to direct the airflow therefrom according to a plurality of user-selectable rotational positions; and wherein the housing further comprises a second exhaust opening, disposed outdoors, and wherein one of the user-selectable positions causes an indoor-to-outdoor airflow direction wherein air is drawn through the housing into the first exhaust opening and out of the second exhaust opening such that the first intake opening is a second intake opening.

2. The evaporative-cooling window fan of claim 1 wherein the indoor-to-outdoor airflow does not pass though the upper portion of the pad.

3. The evaporative-cooling window fan of claim 2 wherein one of the user-selectable positions causes an upwardly-directed outdoor-to-indoor airflow direction and another of the user-selectable positions causes a downwardly-directed outdoor-to-indoor airflow.

4. The evaporative-cooling window fan of claim 3 wherein the director enables the outdoor-to-indoor and indoor-to-outdoor airflows while the blower rotates in the same direction.

5. The evaporative-cooling window fan of claim 4 wherein the housing further comprises a bottle receiver adapted to receive and support a removable and replaceable water supply for filling the reservoir to a desired water level such that the water is retained thereat.

6. The evaporative-cooling window fan of claim 5 wherein the reservoir comprises a valve actuator and the water supply comprises a bottle and a cap assembly, and the cap assembly comprises a valve actuated by the valve actuator when the water supply is received and supported in the bottle receiver.

7. The evaporative-cooling window fan of claim 6 wherein the cap has a nominal 28 mm thread.

8. The evaporative-cooling window fan of claim 7 wherein the bottle is a disposable plastic purified drinking water bottle.

9. The evaporative-cooling window fan of claim 1 wherein one of the user-selectable positions causes an upwardly-directed outdoor-to-indoor airflow direction and another of the user-selectable positions causes a downwardly-directed outdoor-to-indoor airflow.

10. The evaporative-cooling window fan of claim 3 wherein the director enables all airflows while the blower rotates in the same direction.

11. The evaporative-cooling window fan of claim 10 wherein the housing further comprises a bottle receiver adapted to receive and support a removable and replaceable water supply for filling the reservoir to a desired water level such that the water is retained thereat.

12. The evaporative-cooling window fan of claim 11 wherein the reservoir comprises a valve actuator and the water supply comprises a bottle and a cap assembly, and the cap assembly comprises a valve actuated by the valve actuator when the water supply is received and supported in the bottle receiver.

13. The evaporative-cooling window fan of claim 12 wherein the cap has a nominal 28 mm thread.

14. The evaporative-cooling window fan of claim 13 wherein the bottle is a disposable plastic purified drinking water bottle.

* * * * *